US005947702A

United States Patent [19]

Biederstadt et al.

[11] Patent Number: 5,947,702

[45] Date of Patent: Sep. 7, 1999

[54] HIGH PRECISION FLUID PUMP WITH SEPARATING DIAPHRAGM AND GASEOUS PURGING MEANS ON BOTH SIDES OF THE DIAPHRAGM

[75] Inventors: Clifford Biederstadt, Laguna Hills; Gerald B. Costello, Mission Viejo; Arthur J. Heiser, Jr., Costa Mesa, all of Calif.

[73] Assignee: Beco Manufacturing, Laguna Hills, Calif.

[21] Appl. No.: 08/770,909

[22] Filed: Dec. 20, 1996

[51] Int. Cl.[6] ..... F04B 35/04

[52] U.S. Cl. ..... 417/415; 417/53; 92/87; 222/382

[58] Field of Search ..... 417/415, 53; 92/87; 222/382

[56] References Cited

U.S. PATENT DOCUMENTS

| | | | |
|---|---|---|---|
| 4,023,469 | 5/1977 | Miller | 92/86.5 |
| 4,293,807 | 10/1981 | Foster et al. | 318/696 |
| 4,326,837 | 4/1982 | Gilson et al. | 417/12 |
| 4,639,245 | 1/1987 | Pastrone et al. . | |
| 5,085,560 | 2/1992 | Thompson et al. . | |
| 5,132,225 | 7/1992 | Dickakian . | |
| 5,151,395 | 9/1992 | Tom . | |
| 5,196,121 | 3/1993 | Moore et al. . | |
| 5,232,511 | 8/1993 | Bergman . | |
| 5,235,995 | 8/1993 | Bergman et al. . | |
| 5,312,233 | 5/1994 | Tanny et al. | 417/316 |
| 5,357,991 | 10/1994 | Bergman et al. . | |
| 5,370,740 | 12/1994 | Chao et al. . | |
| 5,377,708 | 1/1995 | Bergman et al. . | |
| 5,397,034 | 3/1995 | Wunsch | 222/333 |
| 5,492,457 | 2/1996 | Lee | 417/405 |

*Primary Examiner*—Timothy S. Thorpe
*Assistant Examiner*—Ehud Gartenberg
*Attorney, Agent, or Firm*—Knobbe, Martens, Olson & Bear, LLP

[57] ABSTRACT

A high precision fluid pump for accurately delivering desired amounts of processing fluids, particularly for use in semiconductor processing and semiconductor processors. The fluid is dispensed by a piston driven by a stepper motor with precise electronic control. A rolling diaphragm isolates the stepper motor from the fluid, fumes or gas. To provide a clean environment for high purity applications, the pump is preferably made of PTFE and nitrogen purging is provided on both sides of the rolling diaphragm to reduce particle count and maintain the motor and controller temperature.

24 Claims, 5 Drawing Sheets

HIGH PRECISION FLUID PUMP WITH SEPARATING DIAPHRAGM AND GASEOUS PURGING MEANS ON BOTH SIDES OF THE DIAPHRAGM

FIELD OF INVENTION

This invention relates to a high precision fluid pump, and more particularly to a stepper-motor driven precision pump which includes nitrogen purging for clean environment application.

BACKGROUND OF THE INVENTION

In semiconductor substrate processing or medical applications, it is necessary to provide blended processing fluids of acids, alkalies, and organic solvents, which may include, e.g., mixtures of hydrogen peroxide with sulfuric acid, ammonium hydroxide, or water, or mixtures of hydrofluoric acid blended with water, acidic acid, nitric acid, or phosphoric acid. A pump is used to direct desired amounts of fluid to a processing chamber in which semiconductor wafers, photomasks, other products are being treated or processed.

The pump must be able to withstand the hostile environment created by the aggressive processing fluids. Further, contaminants in the processing fluid need to be kept to a minimum to achieve the clean environment required in high purity applications. Moreover, it is also critical that bacterial growth be inhibited.

Finally, because of the precision required of the mixed fluids, the pump must be able to deliver unusually accurate amounts of processing fluid to the processing chamber. The fluid must also be dispensed with accurate repetition.

Conventional mechanical methods of controlling the pumping action have problems dealing with these precision semiconductor applications. The accuracy needs to be improved, the cleanliness needs to be improved, and the number of particles generated can be reduced. Although electronics can be used, accuracies can still be limited by the inherent imperfection of the mechanical structure. Moreover, there still remains a concern of contamination and pump reliability because of the hostile pump environment.

There is a need, therefore, for a pump that can dispense accurate amounts of fluid with accurate repetition and provide a clean environment for the processing of the fluid therethrough.

SUMMARY OF THE INVENTION

The present invention uses a stepper-motor drive system that includes a stepper motor with electronic control to extract and dispense precise amounts of fluid with accurate repetition. The stepper motor is disposed in a motor chamber and drives a piston in a piston chamber to expel a controlled amount of fluid from the piston chamber into a processing tank.

A personal computer, programmable controller or other type of programming devices as known in the industry can be used to program the controller to control the movement of the drive system to achieve precise extraction and displacement volume and rate.

To protect the stepper-motor drive system and electronics from the aggressive processing fluids, an isolation rolling diaphragm is used to separate the motor chamber from the piston chamber. The rolling diaphragm is preferably made of chemrez and cyclically deforms with every stroke of the piston, isolating the stepper-motor drive system.

To further maintain low particle count, nitrogen is directed through the interior of the pump on both sides of the rolling diaphragm. The nitrogen purging impedes migration of contaminants into the processing chamber, and prevents oxidation inside the pump, and acts to cool the stepper motor and the controller.

In one embodiment of the present invention, the fluid pump comprises a body including a fluid inlet and a fluid outlet, and a fluid chamber, a stepper motor controllable by electronics, a piston reciprocally mounted in a chamber and driven by the stepper motor, and an isolation diaphragm separating the fluid and the motor. The fluid inlet has an inlet valve and the fluid outlet has an outlet valve. The piston is driven by the stepper motor to move between an extracting position and a dispensing position. When the piston moves from the dispensing position to the extracting position, the inlet valve is configured to open and the outlet valve is configured to close. When the piston moves from the extracting position to the dispensing position, the inlet valve is configured to close and the outlet valve is configured to open. The isolation diaphragm is disposed between the stepper motor and the piston to prevent fluid transfer therebetween. With regard to the diaphragm acting to protect the motor, fluid is defined to include liquid, fumes or gas or any combination thereof.

Another embodiment of the present invention includes an on-board controller comprising stepper-motor electronics for controlling the stepper motor.

The components of the pump which have wetted surfaces exposed to the fluids, including the piston and piston chamber, are made of PTFE (polytetrafluoroethylene), a fluorocarbon resin material that is essentially inert to most aggressive acids, alkalies, and organic solvents. Advantageously, other components of the pump are also made of PTFE. PTFE also can tolerate processing temperatures of over 100° C. Processing fluids do not leach into, through, or out of PTFE. Nor does PTFE support bacterial growth. Materials other than PTFE may be suitable for use in the same portions of the pump as PTFE. These other materials include high density polyethylene, poly propylene, PEEK and TFM.

The pump of this invention is believed to limit the particle count to less than 0.2 micron particle per liter of fluid pumped. For fluid volume of less than 9999.9 milliliter (ml), the stepper-motor drive system can achieve resolution of 0.1 ml.

This invention further comprises an advantageous method of accurately pumping fluid while reducing the contaminants the pump adds to the fluid. This process is achieved by providing and placing a piston and a chamber in a housing and reciprocating the piston in the chamber between an extracting position which increases the volume of the chamber and a dispensing position which decreases the volume of the chamber. An inlet valve is placed in fluid communication with the chamber to provide fluid to the chamber when the piston is in an extracting position, and the inlet valve is closed when the fluid is not in an extracting position. An outlet valve is placed in fluid communication with the chamber to provide fluid to the chamber when the piston is in a dispensing position, with the inlet valve being closed when the fluid is not in a dispensing position. A stepper motor is placed inside the housing and in driving communication with the piston to reciprocate the piston. An isolation diaphragm is disposed between said stepper motor and said piston to prevent fluid transfer therebetween. With regard to the diaphragm acting to protect the motor, fluid is defined to include liquid, fumes or gas or any combination thereof.

Advantageously the method further includes the steps of placing a first gas inlet and outlet in fluid communication with a first portion of the housing between the diaphragm and the piston to purge that first portion of the housing with an inert gas; and placing a second gas inlet and outlet in fluid communication with a second portion the housing between the diaphragm and the motor to purge that second portion of the housing with an inert gas. Further, the method advantageously includes the steps of placing an electronic controller inside the housing and in electronic communication with a plurality of sensors and data inputs, and automatically controlling the operation of the pump without external control.

DETAILED DESCRIPTION OF THE PREFERRED EMBODIMENT

Figure 1:
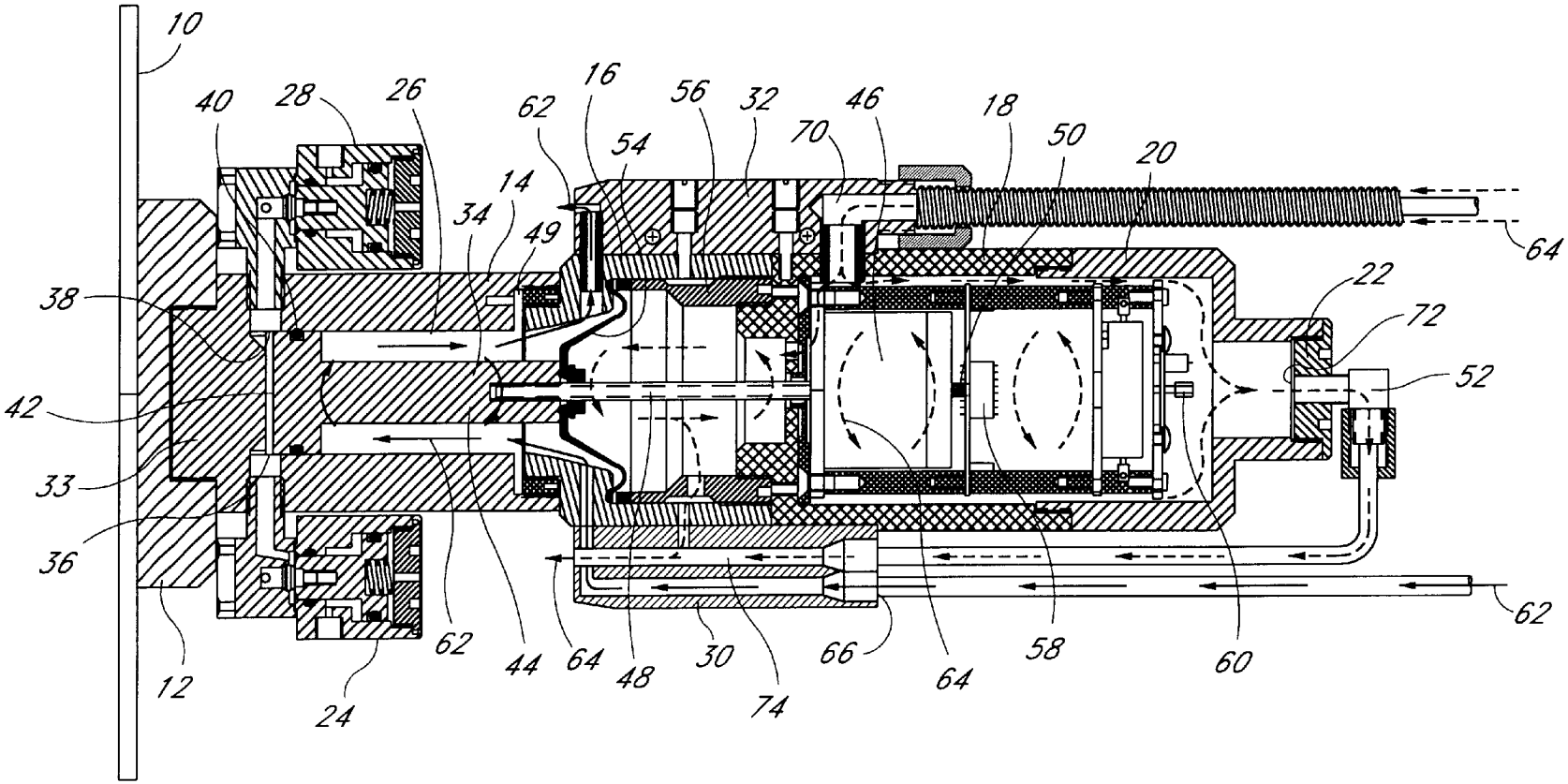
FIG. 1 is a cross-sectional view illustrating a pump in accordance with a first preferred embodiment of the present invention.

FIG. 1 illustrates the first preferred embodiment of a pump. The pump includes a baseplate 10 which supports a base 12 attached to a body 14. The body 14 is connected to a diaphragm housing 16 attached to a motor housing 18. A cover 20 cooperates with the motor housing 18 and is enclosed by a cap 22. An inlet valve assembly 24 is provided to regulate fluid flow into a fluid cavity 26 inside the body 14. An outlet valve assembly 28 controls fluid flow out of the cavity 26 of the body 14. Piston manifolds 30 and motor manifold 32 provide flow connections to sources of purging gas, such as nitrogen.

Referring to FIG. 1, the baseplate 10 has sufficient surface area to support the base 12 of the pump in a vertical position. The baseplate 10 can also be mounted in other orientations and angles (not shown). The base 12 provides support for the body 14, and inlet assembly 24 and outlet valve assembly 28. The base 12 and baseplate 10 are made of sufficiently strong material to support the pump during operation, and are advantageously made of PTFE.

The body 14 is desirably a circular cylinder with an internal cylindrical cavity 26 enclosed at one end of the cavity by the cavity end fitting 33 that is mounted to the base 12. A piston 34 is disposed inside the cavity 26 of the body 14 and configured to move back and forth along the cavity. The cavity 26 is cylindrical in shape and is desirably a circular cylinder with a first opening 36 near the enclosed end in fluid communication with the outlet valve assembly 28. The movement of the piston 34 is along the longitudinal axis of the cavity 26 in the body 14.

The cavity 26 is used for accumulating the fluid for distribution. The fluid enters through the inlet valve assembly 24 and exits through the outlet valve 28, which are both desirably check valves that employ a pneumatic spring-biased diaphragm adjacent an orifice. Other valve configurations could be used, such as spring-loaded ball valves. For compactness, the valves 28 and 24 are advantageously disposed at a 90° bend as shown in FIG. 1. The operation of the valves 28 and 24 is discussed in more detail below in conjunction with a pumping cycle or stroke.

The piston 34 desirably includes a cylindrical piston having a diameter slightly smaller than the inner diameter of the cavity 26 to provide a sliding fit. The spacing between the piston head and cavity wall should be as small as possible while still allowing smooth sliding motion for the piston 34. An O-ring seal 40 interposed between the piston 34 and the cavity 26 provides a fluid-tight seal. The O-ring 40 is made of chemrez 570 to reduce particle generation while providing a good sliding seal. The flat piston head 42 faces the enclosed end of the cavity 26, and is wetted by the fluid during the pumping cycle.

The piston 34 has a piston shaft 44 attached to the piston which is opposite the front side. The piston shaft moves in and out of the cavity 26 during pumping cycles. The piston shaft is advantageously a round shaft with a diameter smaller than the diameter of the piston head.

As seen in FIG. 1, the cavity 26 of the body 14 has a front portion through which the fluid enters and exists, and a back portion in which the piston shaft is disposed. The volume of the front and back portions change as the piston 34 moves back and forth during pumping. The piston 34 moves between two fully extended positions, a fully extracted position where the volume of the rear position is at a minimum, and a fully dispensed position where the volume of the front portion is at its minimum and the volume of the back portion reaches its maximum. The piston 34 undergoes a full stroke as it moves from a fully extended position, say the extracting position, to the dispensing position and back to the extracting position. FIG. 1 shows the piston 34 approaching its fully extended position, with the piston head 42 almost contacting end fitting 33. Actual contact should be minimized as it can generate particulate contaminants.

A clocking plate 49 is provided near the back end of the body 14. It has two flanges anchored at two opposing grooves provided in the body 14 to prevent rotational motion. The clocking plate 49 partially encloses the open end of the back portion of the cavity 26 and has a hole at the center through the piston shaft 44 reciprocates. The plate 49 has tangs that cooperate with grooves in shaft 44 to limit rotation of shaft 44. Alternatively, the shape of shaft 44 can have flat sides that cooperate with the shape of the aperture in clocking device 49 through which the shaft 44 slides to prevent rotation of the piston 34 and shaft 44.

The piston 34 is driven by a motor 46 via the piston shaft 44. In FIG. 1, the motor 46 is housed in the motor housing 18 and provides a drive bar 48 which is attached to a distal end of the piston shaft 44 to transfer motion to the piston 34. The drive bar 48 can be attached to the piston shaft 44 in various ways, but is desirably affixed to a cavity at the center of the piston shaft near its free end. The drive bar 48 conveys a translation motion to move the piston shaft 44 along the longitudinal axis of the body 14, and is advantageously a straight, rigid tube disposed parallel to the longitudinal axis of the body 14, with a first end affixed to the piston shaft and a free, second end 50. A portion of the drive bar cooperates with the motor 46 for transfer of a driving force on the piston shaft.

The motor 46 is preferably a rotary stepper motor that engages a threaded rod thereby translating the rotary motion to linear motion to provide precise displacement of the piston 34 for dispensing an accurate amount of fluid through the outlet valve 12. The mechanics and precision of stepper motors are known in the art. Any suitable stepper motor with at least one-dimensional movement can be used. A commercial available stepper motor 46 has enabled the pump to extract and displace fluid with accurate repetition at a resolution of better than 0.1 ml per volumes of less than 9999.9 ml. The stepper motor 46 is preferably controlled by an electronic controller 76 (not shown). The controller generates a signal to the stepper motor 46 to instruct it to move accordingly drive bar 48, piston shaft 44 and piston 34 a predetermined distance that results in a predetermined change in the volume of cavity 26, to precisely expel fluid from the cavity. The piston 34 is controllable throughout its entire stroke. Various feedback control mechanisms are known for ensuring the stepper motor accuracy and are not described in detail herein.

The motor housing 18 is enclosed by the cover 20 and cap 22 as shown in FIG. 1. The cover 20 has an elongated protrusion near the cap 22 to permit displacement of the drive bar 48 thereto so that the free end 50 of the drive bar does not hit the cover 20, even when the piston 34 and the drive bar have a long stroke. The cap 22 has an opening which leads to an elbow 52 to form a flow channel for nitrogen purging. The details of the structure and operation of nitrogen purging is discussed in more detail below.

The piston 34 preferably has a sufficiently long stroke relative to the volume of cavity 26 so that it can pump the desired volume of fluid in one stroke, which is more accurate than requiring several cycles of short strokes that refill the cavity 26 between strokes. The elongated protrusion of the cover 20 therefore has the advantage of accommodating a piston 34 with longer strokes without substantially enlarging the size of the pump.

It is important to maintain the motor housing 18 free of contamination. One source of contamination is the wetted surface along the cavity wall of the body 14 when the piston 34 is moved to the fully extended dispensing position. To prevent the contamination from the motor 46 from reaching the cavity 26, an isolation diaphragm 54 is disposed in the diaphragm housing 16 near the second end of the piston shaft 44. The diaphragm 54 is desirably a rolling diaphragm which is affixed to the diaphragm housing 16 and the distal end of the piston shaft 44 to completely block the space therebetween, thereby preventing fluid communication between the body 14 and motor housing 18. With regard to the diaphragm 54 acting to protect the motor 46, fluid is defined to include liquid, fumes or gas or any combination thereof. The rolling diaphragm 54 is advantageously made of chemrez, which can deform repeatedly between a concave shape and a convex shape over numerous piston strokes, and is inert to the aggressive processing fluids.

In the diaphragm housing 16 is provided a diaphragm retainer 56 disposed near the junction between the diaphragm housing 16 and the motor housing 18 to constrict the deformation of the diaphragm 54 for smooth movement through the piston stroke. As seen in FIG. 1, the diaphragm 54 is desirably also attached to a portion of the drive bar 48 since the drive bar is connected to the second, distal end of the piston shaft 44. The diaphragm housing 16 abuts the motor housing 18.

The operation of the piston 34 driven by the stepper motor 46 in conjunction with the inlet valve assembly 24 and outlet valve 28 to effect fluid pumping is described as follows. The default position of the piston 34 is shown in FIG. 1, i.e., at the fully extended dispensing position. The inlet valve assembly 24 and outlet valve 28 are closed with the spring-biased diaphragms block the orifices. A bleed-out orifice (not shown) is provided between the valves 24 and 28 near the end fitting 33 to let all the air out of the cavity 26 for priming the pump prior to pumping operation, and to increase the pump accuracy by eliminating compressible air from the cavity 26. To bleed air out of the cavity 26, the inlet valve assembly 24 is connected to a fluid source and the stepper motor 46 is activated to drive the piston 34 open toward the diaphragm housing 16. Fluid accumulates in the cavity 26. The piston 34 is then pushed back to its closed position, thereby driving out most of all of the air out through the outlet valve 28.

After the inlet valve assembly 24 is connected to a fluid source and the outlet valve 28 is connected to the appropriate output such as a processing chamber, the stepper motor 46 drives the piston 34 with the drive bar 48 and moves it toward the diaphragm housing 16. The inlet and outlet valves 24 and 28 are actuated by a pilot valve located elsewhere (not shown). These are pneumatic valves and can be actuated to open and close at any given time. With inlet valve 24 opened and outlet valve 28 closed, the piston 34 can be retracted to cause the fluid to flow into the front portion of the cavity 26 between the piston head 42 and end fitting 33, filling the cavity 26 at the top of the piston stroke. To dispense the fluid from the cavity 26, the inlet valve 24 is closed, outlet valve 28 is opened, and piston 34 is pushed toward the base 12 to a desired position determined by the desired amount of fluid to be dispensed.

Alternatively, the inlet valve 24 can be closed, the outlet valve 28 opened, and the piston 34 retracted to create a predetermined volume in the cavity 34. The outlet valve 28 is then closed, the inlet valve opened, and the piston 34 driven toward the base 12 expelling any gases in the chamber 26 through the inlet valve 24. The piston 34 is then retracted to refill chamber 26 with fluid passing through the inlet valve 24.

To dispense or displace the fluid, the controller reverses the direction of stepper motor 46 and moves the piston 34 toward the end fitting 33, exerting a compressive pressure on the accumulated fluid. The inlet valve assembly 24 remains closed while the spring-biased diaphragm at the outlet valve 28 is pushed open by the pressure. The fluid is dispensed as the piston 34 completes one stroke of whatever length is determined by the controller. For the pump shown in FIG. 1, the maximum capacity of volume dispensed is 200 ml per stroke. The next pumping cycle can being after all fluid is dispensed by one, or several controlled expulsions. Alternately, a partially empty cavity 26 can be filled before expelling additional fluid. The precise sequence can be controlled by the computer activated controller.

To ensure proper functioning of the piston 34 and prevent collision of the end 50 drive bar 48 with the cover 20 or cap 22, or other parts of the pump, sensors are provided to detect the position of the drive bar 48. The presence or absence of the drive bar 48 at a certain location is detected by the sensors. The presence of the drive bar 48 at a particular location may signal a need to limit the minimum volume motion (i.e., toward the dispensing position), while the absence of the drive bar 48 at another location may indicate a need to limit the maximum volume motion (i.e., toward the extracting position).

Advantageously, one limit sensor 58 is positioned to detect the absence of the drive bar 48 to limit the maximum extended stroke of piston 34 and prevent the piston head 42 from being forced into the end fitting 33. A photodetector has proven suitable. Another limit sensor 60 can detect the presence of the drive bar 48 to limit the maximum retraction of the piston 34 and prevent the piston head from hitting the clocking plate 48. A photodetector is suitable for this limit sensor 60.

Gas pursing is advantageously used to impede migration of contaminants into the processing chamber, and to remove particles generated by the pump and cool the stepper motor 46 and the controller 76. Nitrogen is a preferable gas. Nitrogen purging is advantageously provided at both sides of the diaphragm 54, i.e., in the piston region between the piston 34 and diaphragm 54, as illustrated by the single lines 62, and the motor region between the diaphragm 54 and the motor 46, as illustrated by the dashed lines 64.

Manifolds 30 and 32 desirably provide flow connections for nitrogen purging. For the purging shown in single lines 62, nitrogen gas enters through a hose or tube provided at the manifold 30 into the back portion of the body 14 and cavity 26 via a first inflow channel 66. The gas exits through a first outflow 68 channel disposed at the opposite side from the first inflow channel.

For the purging shown in dashed lines 64, nitrogen gas enters through another tube or hose into the motor housing 18 via a second inflow channel 70 and circulates around motor 46, through the motor housing 18 and the diaphragm housing 16. The gas exits the motor housing 18 through the opening 72 provided at the cap 22 and turns at the elbow 52 as it follows a second outflow channel disposed on the opposite side from the second inflow channel.

Second Embodiment

Figure 2:
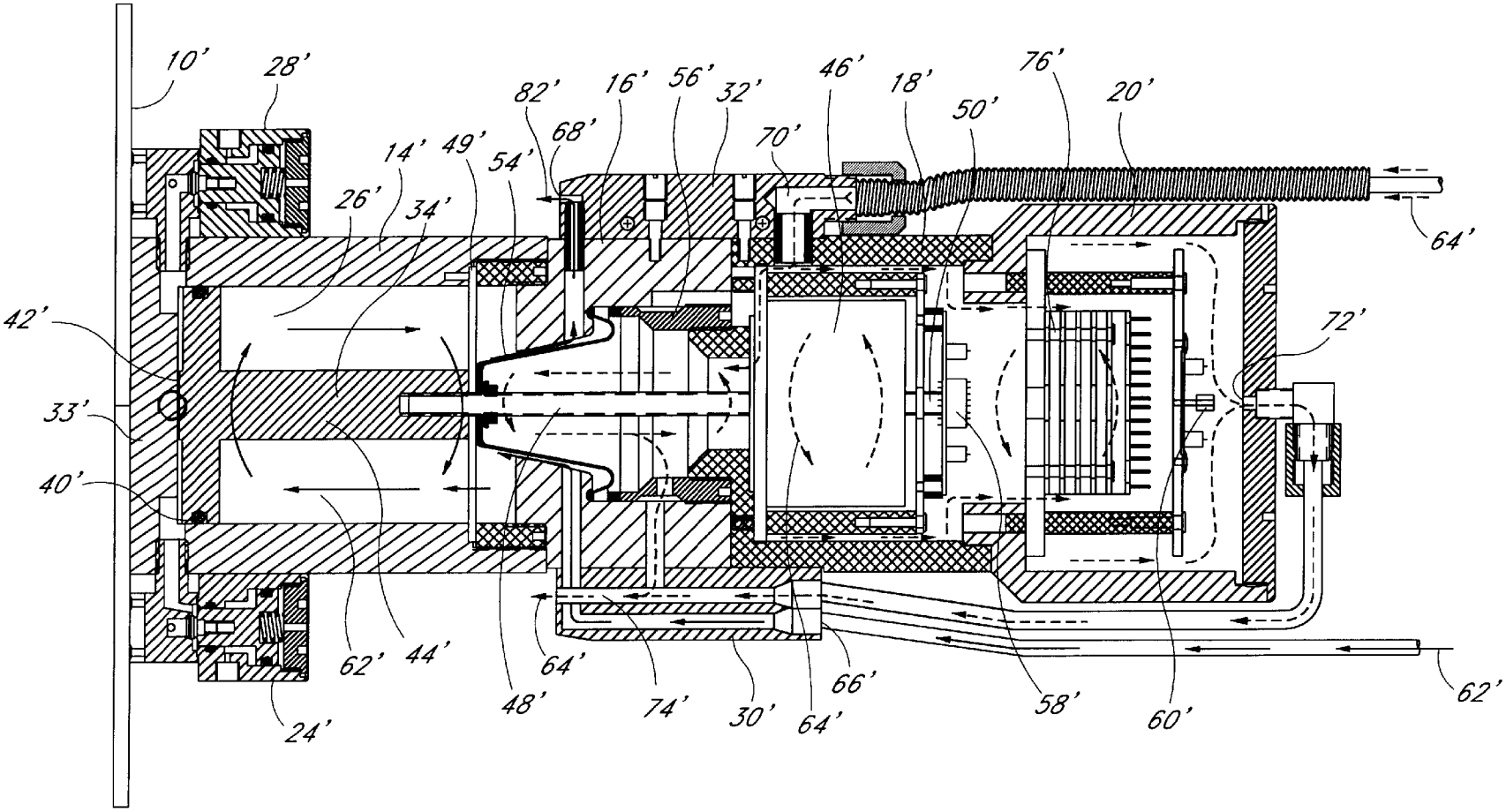
FIG. 2 is a cross-sectional view illustrating a pump with an on-board controller in accordance with a second preferred embodiment of the present invention.

FIG. 2 shows a second preferred embodiment. The operation of the second embodiment is essentially the same as that of the first embodiment of FIG. 1 and the parts are numbered accordingly, but with a single prime. The description of those like-numbered parts will not be repeated. The main difference in this second embodiment is that the pump has a higher capacity, 750 ml per stroke. Because the size of the second pump is larger, a controller 76' is advantageously included inside the pump and is disposed on a circuit board adjacent the motor 46' in the region defined by the cover 20' and cap 22'. The controller 76' could be similarly located in the other embodiments of this invention. A commercially available controller 76' can be used as long as it can provide the desired precision. Note that no protruded portion need be provided at the cover 20' because the pump is sufficient long for the piston stroke without concern for interference between the drive bar 48' and the cover 20'.

Third Embodiment

Figure 3:
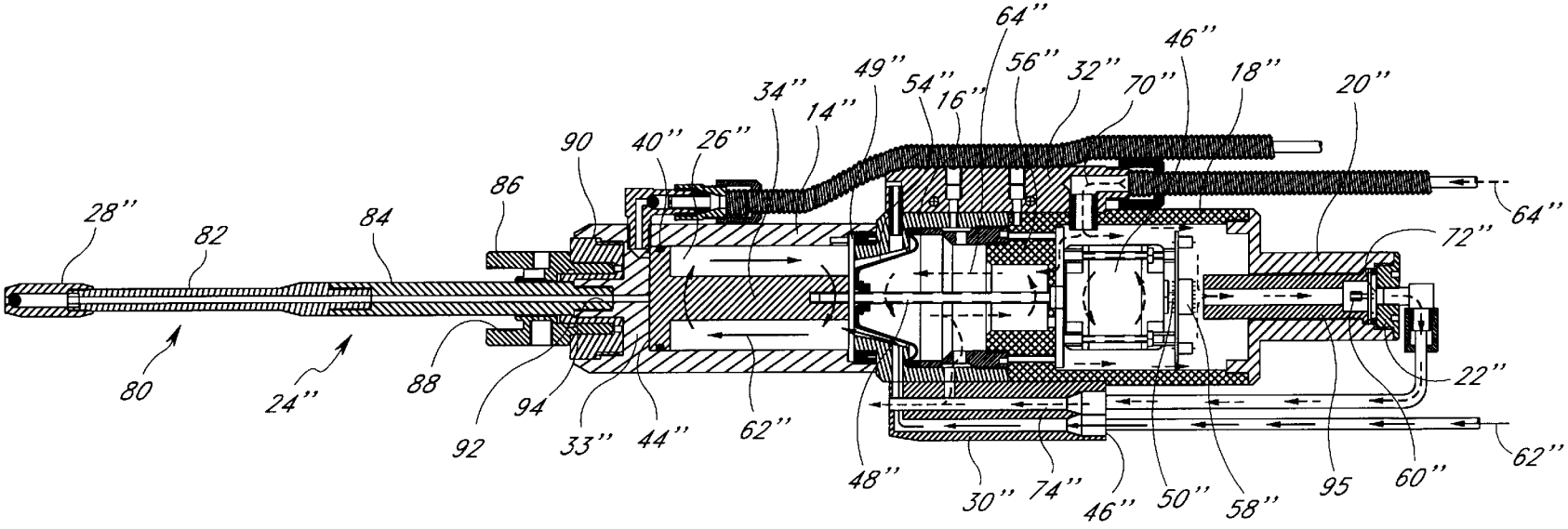
FIG. 3 is a cross-section view illustrating an adaptable pump in accordance with a third preferred embodiment of the present invention.

While the pumps in accordance of the first and second embodiments (FIGS. 1, 2) are free-standing, the pump provided in the third embodiment, as shown in FIG. 3, is not free-standing, but rather adaptable to a fluid container such as a standard chemical bottle. Like parts are numbered alike in FIG. 3, but with a double prime, ", notation. The description of those like-numbered parts will not be repeated.

The significant change from the first embodiment of FIG. 1 is that the inlet valve 24" is configured in a different way. As seen in FIG. 3, the baseplate 10 is replaced by an insert 80 adaptable to a standard chemical bottle via the bottle cap, which provides quick connection and disconnection to the bottle. The inlet valve 24" is desirably a check ball valve instead of a pneumatic valve as in the embodiment of FIG. 1, but it is disposed at the tip of an elongated, tubular pickup formed by axially connected tubes 82, 84. Gravity biases the check ball in a closed position blocking an orifice as the pump is oriented vertically downward. For other arrangements, spring-biased check ball or pneumatic valves can also be used. The tubular pickups 82, 84 are sufficiently long to reach the bottom of a chemical bottle to which the pump is attached. The check ball is desirably ¼ inch in size.

The tube 84 fits into a quick disconnect bottle-cap 86. The cap 86 screws onto a chemical bottle through threads 88. A first end of the cap 86 is configured to receive one end of the tube 84. A second end of the cap 86 is configured to slide into a mating end of the pump body 14", through a mating adapter 90. The adapter 90 is threaded into the end of the body 14" adjacent the end fitting 33", and contains an aperture configured to receive the second end of the cap 86. An O-ring seal 92 between the second end of the cap 86 and the adapter 90 provides a sliding, but sealed, quick disconnect arrangement. A tubular aperture 94 through the center of the end fitting 33" places the inlet valve 24" in fluid communication with the cavity 26".

Advantageously, the inlet valve 24" of the adaptable pump is directly inserted into a chemical bottle which places it in fluid communication with the pump and no additional tubing is needed to connect the bottle to the inlet valve 24". The pickup tube 82, 84, and the quick-disconnect cap 86 are desirably made of PTFE, as they come into direct contact with the aggressive fluid. The third embodiment therefore provides a convenient way of supplying the fluid to the pump.

At the opposite end of the pump a tubular wire shield 95 is shown attached to, and in fluid communication with, aperture 72". The free end of reciprocating drive bar 48" can enter the center of shield 95. When electrical wires (not shown) connect to the pump through the cap 22, the shield 95 prevents the drive bar 48" from entangling the wires.

Controller Variation

Figure 4:
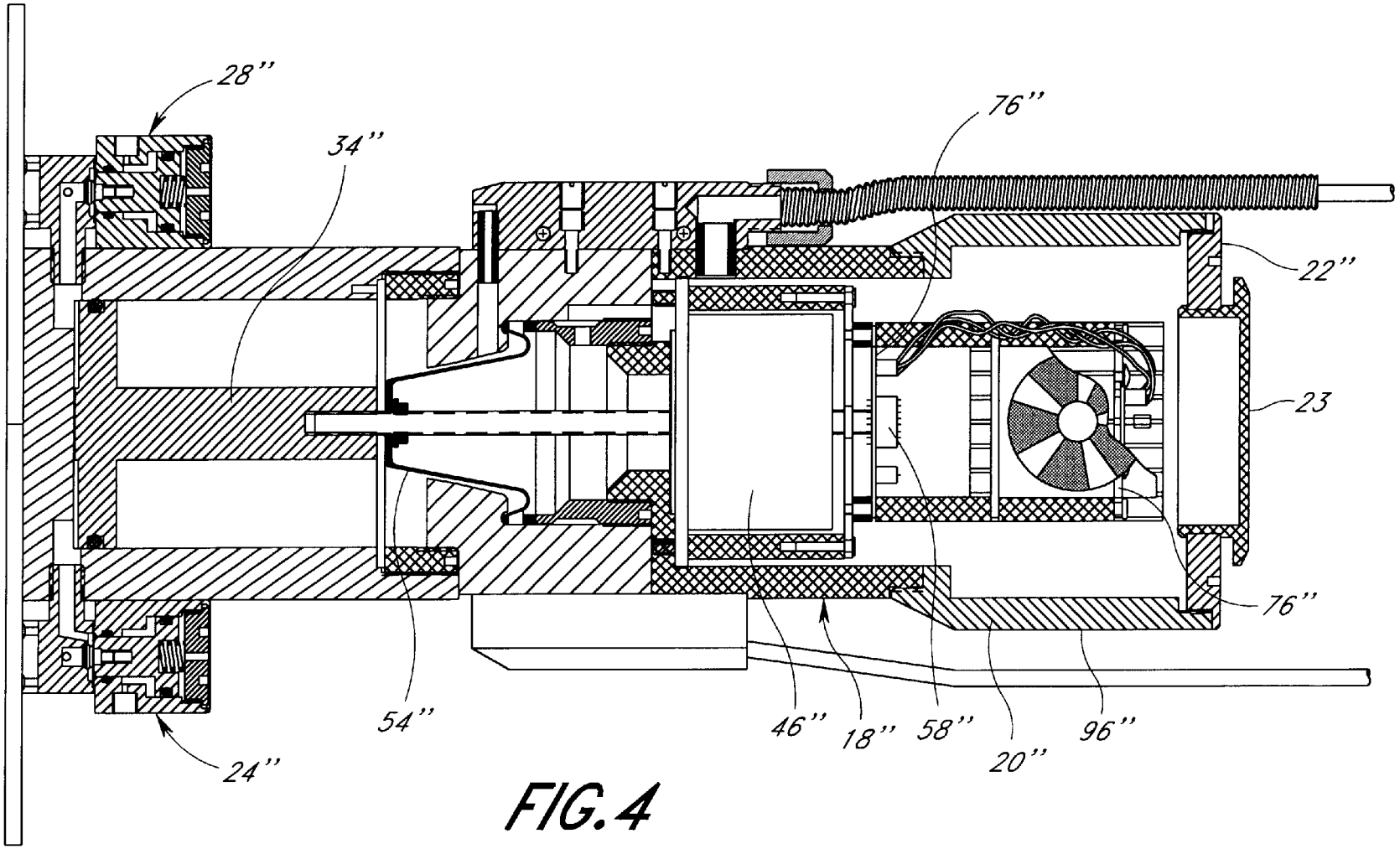
FIG. 4 is a cross-section view illustrating a further variation of the pump of FIG. 2.

A further embodiment of this invention has an enhanced, internally located controller as shown in FIG. 4, and will use the nomenclature of the embodiment of FIG. 2 for similar parts. This controller 76' is equally suitable for use with the other embodiments of this invention.

The controller 76' is enclosed within the pump housing 18'. To allow easy access to the controller 76' the cover 20' may be removably connected to the housing 18', as by threading a cylindrical cover 20' onto the remainder of the housing 18'. An end cap 22' at the end of the generally cylindrical cover 20' is also removable, and advantageously has a centrally located, removable cap or cover 23' to allow access through the end of the cover 20'. Depending on the power and operational requirements of the controller 76', a fan 96 may be added inside the housing 18 to ensure circulation of the nitrogen which in turn maintains the temperature of the stepper motor 46' and the controller 76' within the desired temperature ranges.

Figure 5:
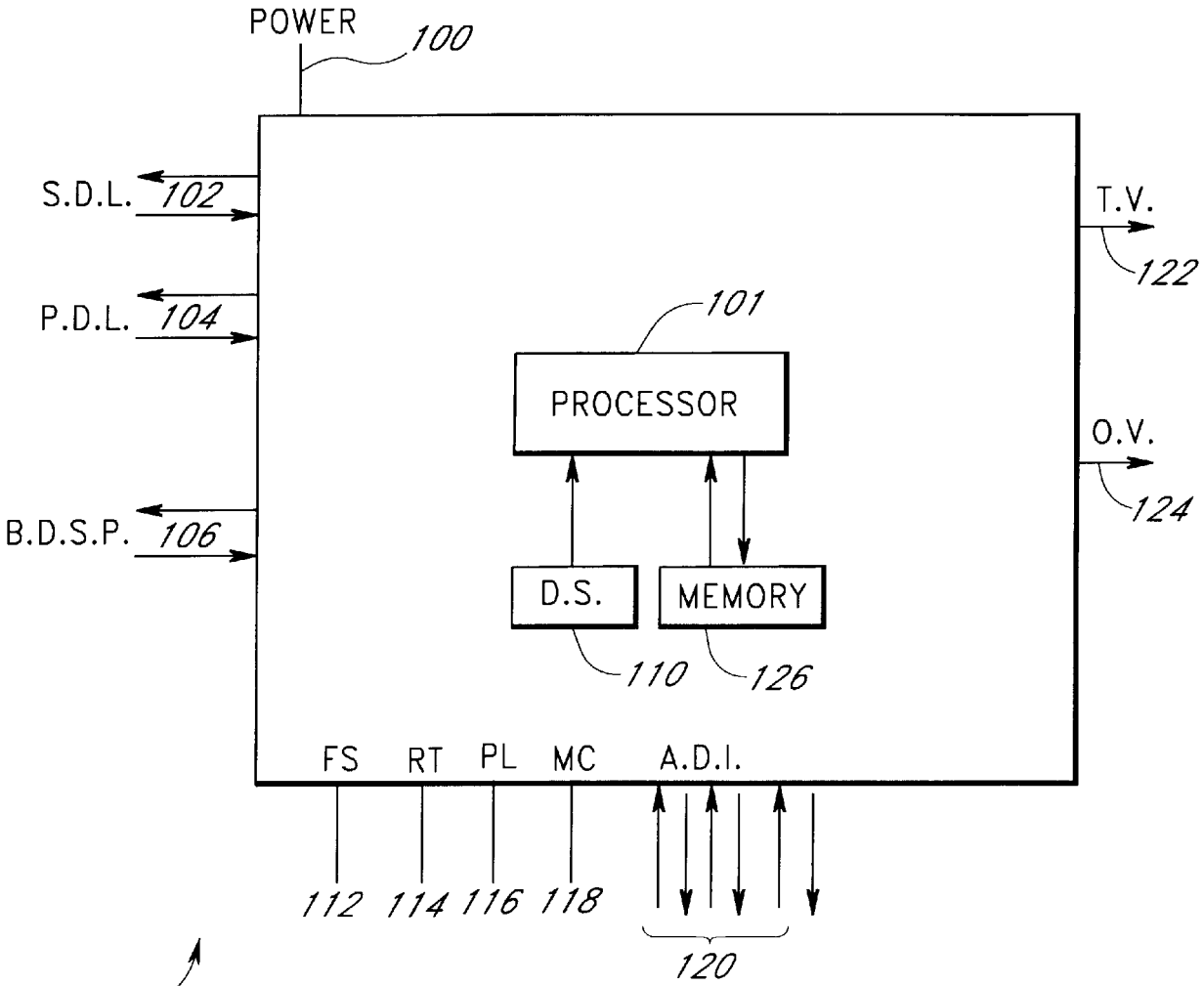
FIG. 5 is a basic block diagram of the controller.

The controller 76' controls multiple functions of an electromechanical device, and may take the form of a circuit board with appropriately configured integrated circuits. Preferably, the controller 76' is a electronic micro-controller based control system. A basic block diagram of the controller 76' is shown in FIG. 5. A power input line 100 provides power to the controller 76'.

The controller 76' has data inputs 102–106 to receive and transmit data signals that control the stepper motor 46' and the pump inlet and outlet valve assemblies 26', 28'. The controller 76' advantageously has both parallel data lines 104 and serial data lines 102 to allow for integration with a variety of control topologies. But preferably, the controller 76' has a balanced differential serial data port 106 thereby providing additional input-output flexibility. Further, a balanced differential serial data port allows for multi-drop capabilities at remote locations without noise interference or data signal degradation.

The controller 76' also has a processor 101 and memory 126. The processor 101 and memory 126 work in conjunction with software (not shown) to control operations of the pump. Given the present disclosure, one of ordinary skill in the art could devise numerous software programs and thus the software is not disclosed in further detail. Customized firmware could be used to enhance pump operation so that the pump could be completely controlled from a location internal to the pump housing. Additionally, the preferred embodiment includes an eight position dipswitch 110 that identifies each of several pumps by providing address information for each pump in multiple pump installations, or to provide mode selectability if a variety of firmware modes for different pump models and applications are used. Advantageously, the firmware controls the entire operation of the pump without the need for external data input, although the controller 76' is adaptable to external control, to autonomous internal control, and to various combinations of internal and external control for various functions.

The controller 76' has additional data inputs to receive data from sources within the pump. A first internal data input 112 receives data from extended piston limit sensor 58'. Likewise, a second internal data input 114 receives data from the retracted piston limit sensor 60'. A third data input 116 receives data from a piston location sensor (not shown) to determine the location of the piston 34' between the limit sensors 58', 60'. Advantageously, these sensors, in conjunction with the controller 76', control the stepper motor 46' thereby achieving precise fluid dispersement and motor protection.

A fourth data input 118 provides for additional motor control capabilities by accepting data for motor control, including data related to motor or piston direction, the number and direction of steps, disable, and test modes. Additional data inputs 120 may receive feedback from external data sensors (not shown) that will vary with the particular use of the pump. For example, a fluid level sensor on the fluid supply to the inlet valve assembly 24' could provide feedback to the controller 76' to cease pump operation if the fluid is exhausted. In a further example, a feedback device such as a flowmeter (not shown) could be used in conjunction with the controller 76' to provide closed-loop control of volume and flow through the pump. As known by those with skill in the art, the flowmeter feedback loop can be used in conjunction with calibration algorithms that are specific to each application to adjust pumping speed to achieve the desired volume output over time. In all cases though, all data inputs are optically coupled and filtered to provide noise and electrical immunity between the controller 76' and outside electromagnetic interference. In yet another example, a voltage regulator may standardize the magnitude of the input voltage thereby enabling the controller to accept inputs of varying voltage.

The controller 76', with the data received from data inputs 102–120, operate to precisely actuate the stepper motor 46' thereby extending or retracting the piston to effectuate fluid flow. Advantageously, the controller 76' is capable of driving the motor 46 using full step, half step, or micro-step techniques depending on the pumping requirements or application. The availability of such precise motor control allows for a variety of torque capabilities and the avoidance of unwanted first order resonance that can occur in stepper type motors.

The electrical signals actuating the stepper motor 46' are synchronized with an optional electric intake valve data line 122 and an optional electric outlet valve data line 124. The synchronization ensures that the electrical outlet valve 28' is open and the electrical intake valve 24' is closed when the stepper motor 46' is extending the piston. Conversely, synchronization ensures that the electrical outlet valve 28' is closed and the electrical intake valve 24' is open when the stepper motor 46' is retracting the piston. Advantageously, the electrical valves 24,28 which are normally in a closed position, also prevent siphoning of fluid through the pump.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A fluid pump, comprising:

a housing including a fluid inlet and a fluid outlet in fluid communication with a fluid chamber, said fluid inlet having an inlet valve and said fluid outlet having an outlet valve;

a stepper motor controllable by electronics, the motor being contained in said housing;

a piston driven by a non-rotating drive shaft of said stepper motor between an extracting position and a dispensing position, said inlet valve being configured to open and said outlet valve being configured to close with said piston moving from said dispensing position to said extracting position, and said inlet valve being configured to close and said outlet valve being configured to open with said piston moving from said extracting position to said dispensing position;

an isolation diaphragm disposed between said stepper motor and said piston to prevent fluid transfer therebetween;

a first gas inlet and outlet in fluid communication with a first portion of the housing between the diaphragm and the piston to allow a gas purge of that portion of the housing; and a second gas inlet and outlet in fluid communication with a second portion the housing between the diaphragm and the motor to allow a gas purge of that portion of the housing.

2. The fluid pump of claim 1, wherein the body and piston are made of PTFE.

3. The fluid pump of claim 1, wherein the isolation diaphragm is a rolling diaphragm made of a material that can deform repeatedly between a concave shape and a convex shape.

4. The fluid pump of claim 1, further comprising an electronic controller located inside the housing and in electronic communication with a plurality of sensors and data inputs to control the operation of the pump.

5. The fluid pump of claim 2, further comprising an electronic controller located inside the housing in electronic communication with a plurality of sensors and data inputs to automatically control the operation of the pump without external control, and wherein the body and piston are made of PTFE, with the body completely enclosing the motor.

6. The fluid pump of claim 1, wherein the body and piston are made of PTFE.

7. The fluid pump of claim 1, wherein the isolation diaphragm is a rolling diaphragm made of a material that can deform repeatedly between a concave shape and a convex shape.

8. The fluid pump of claim 1, wherein the body includes an elongated pickup portion which is insertable onto a fluid container, the fluid inlet being disposed in said pickup portion and configured to be immersed in a fluid inside said fluid container, the fluid inlet being in fluid communication with the piston.

9. The fluid pump of claim 1, further comprising an electronic controller located inside the housing and in electronic communication with a plurality of sensors and data inputs to control the operation of the pump.

10. The fluid pump of claim 2, further comprising an electronic controller located inside the housing in electronic communication with a plurality of sensors and data inputs to automatically control the operation of the pump without external control.

11. A fluid pump, comprising:

a housing having a fluid inlet valve means and a fluid outlet valve means in fluid communication with a fluid chamber for controlling the fluid flow into and out of the chamber;

an electronically controlled stepper motor contained in said housing;

piston means driven by said stepper motor and movable in a fluid tight chamber for extracting fluid through the inlet valve and dispensing fluid through the outlet valve;

diaphragm means disposed between said stepper motor and said piston for preventing fluid transfer therebetween;

first gas inlet and outlet means for purging a first portion of the housing between the diaphragm and the piston; and second gas inlet and outlet means for purging a second portion of the housing between the diaphragm and the motor.

12. The fluid pump of claim 11, wherein the body and piston are made of PTFE.

13. The fluid pump of claim 12, wherein the isolation diaphragm is a rolling diaphragm.

14. The fluid pump of claim 13, wherein the body includes elongated pickup means releasably connectable to a fluid container for communicating fluid to the inlet valve means.

15. The fluid pump of claim 13, further comprising electronic control means located inside the housing and in electronic communication with a plurality of sensors and data inputs for controlling the operation of the pump.

16. The fluid pump of claim 13, further comprising an electronic control means located inside and in electronic communication with a plurality of sensors and data inputs for automatically controlling the operation of the pump without external control.

17. A method of pumping fluid while reducing the contaminants the pump adds to the fluid, comprising the steps of:

providing a pump having a piston reciprocating within a cylinder to pump fluid through an outlet of the cylinder, the piston being reciprocated by a stepper motor, the piston and motor being enclosed within a pump housing;

placing an isolation diaphragm between the stepper motor and the piston, the diaphragm cooperating with the housing to define a first chamber containing the reciprocating piston and a second chamber on an opposing side of the diaphragm containing the motor; and while the piston is reciprocating, passing a first independent stream of inert gas through the first chamber and passing a second independent stream of inert gas through the second chamber to purge contaminants from the first and second chambers.

18. The method of claim 17, wherein the piston and at least the portions of the housing contacting the piston are made of PTFE.

19. The method of claim 17, wherein the isolation diaphragm comprises a flexible diaphragm.

20. The method of claim 17, wherein the isolation diaphragm comprises a rolling diaphragm.

21. The method of claim 17, further comprising the steps of placing an electronic controller inside the housing and in electronic communication with a plurality of sensors and data inputs, and automatically controlling the operation of the pump without external control.

22. The method of claim 18, wherein the isolation diaphragm comprises a flexible diaphragm.

23. The method of claim 22, wherein the isolation diaphragm comprises a rolling diaphragm.

24. The method of claim 23, further comprising the steps of placing an electronic controller inside the housing and in electronic communication with a plurality of sensors and data inputs, and automatically controlling the operation of the pump without external control.

* * * * *